United States Patent [19]

Nett

[11] 4,047,519

[45] Sept. 13, 1977

[54] VENTILATING APPARATUS

[76] Inventor: Louis A. Nett, Box 199N Rte. No. 1, Cambridge, Wis. 53523

[21] Appl. No.: 719,828

[22] Filed: Sept. 2, 1976

Related U.S. Application Data

[63] Continuation-in-part of Ser. No. 552,228, Feb. 24, 1975, Pat. No. 3,978,777.

[51] Int. Cl.[2] ..... F24C 15/20

[52] U.S. Cl. ..... 126/299 D; 55/DIG. 36

[58] Field of Search ..... 98/36, 40 N, 115 K; 126/299 R, 299 A, 299 B, 299 D; 55/DIG. 18, DIG. 36

[56] References Cited

U.S. PATENT DOCUMENTS

| | | | |
|---|---|---|---|
| 2,748,688 | 6/1956 | Smith | 98/115 K |
| 3,400,649 | 9/1968 | Jensen | 98/115 K |
| 3,457,850 | 7/1969 | Sweet et al. | 98/115 K |
| 3,505,989 | 4/1970 | Truhan | 98/36 |
| 3,664,255 | 5/1972 | Kuechler | 98/115 K |
| 3,865,021 | 2/1975 | De Lepeleire | 98/36 |
| 3,890,887 | 6/1975 | Kaufman et al. | 98/115 K |

*Primary Examiner*—Ronald C. Capossela
*Attorney, Agent, or Firm*—Andrus, Sceales, Starke & Sawall

[57] ABSTRACT

Ventilating apparatus having an exhaust hood for mounting above a stove, grill, or other apparatus. Ambient air from outside the room being ventilated is forced into an insulated intake chamber within the exhaust hood through a relatively narrow longitudinal slot at the bottom of the intake chamber, thence directed rearwardly and upwardly across a fume collection chamber, through a grease filter, and into an exhaust chamber from which the fumes are exhausted to the atmosphere by a fan. The outside air is forced through the slot in a fast moving narrow stream to form an air curtain across the fume collection chamber with minimal mixing of the fume laden air and the air curtain. Tempered air is introduced into the room being ventilated adjacent the exhaust hood to provide a minimum influx of tempered air from the room being ventilated into the hood to prevent dissipation fumes into the room, and to facilitate collection of such fume laden air by the exhaust hood.

14 Claims, 4 Drawing Figures

VENTILATING APPARATUS

FIELD OF THE INVENTION

This is a continuation-in-part of application Ser. No. 552,228, filed Feb. 24, 1975 of Louis A. Nett, now U.S. Pat. No. 3,978,777.

This invention pertains generally to ventilating apparatus and exhaust hoods for ventilating a room such as a kitchen where fumes from a stove, grill, cooker or other device are generated.

DESCRIPTION OF THE PRIOR ART

The mose widely used exhaust hood in restaurant kitchens and in other similar operations consists of a hood enclosure which is spaced somewhat above the stove or cooker for drawing fume laden air into the hood by means of an exhaust fan usually mounted on the roof of the building being ventilated. A filter may be employed within the exhaust hood enclosure to filter out a substantial portion of the grease and other fume particles which are entrained within the air moving into the exhaust hood. The exhaust fan must be adequate to generate sufficient suction to draw air into the exhaust hood at a high enough rate so that the fume particles arising from the stove beneath do not dissipate into the surrounding atmosphere, but are rather drawn up into the hood by the flow of air therein. The amount of air which must be withdrawn from the room by the exhaust hood is often prescribed by building codes which may typically require that 100 cubic feet per minute be exhausted for every square foot of hood opening area. The amount of air that must be exhausted to meet the requirements of the building codes and to satisfactorily exhaust the room of fume laden air is so great that the heated or cooled air of the kitchen may be exhausted in a very short period of time, which places a great load on the heating and air conditioning equipment and is very uneconomical and wasteful of energy.

Attempts have been made to pass a certain portion of the required amount of air directly into the hood without first introducing this air into the room being ventilated. However, the known systems of this type do not substantially reduce the amount of tempered air that is exhausted from the room in order to satisfactorily exhaust the fumes arising from the cooking area. Such systems have also been subject to the accumulation of undesirable amounts of grease and condensates on the interior of the hood, necessitating frequent and time consuming cleaning thereof.

SUMMARY OF THE INVENTION

I have invented ventilating apparatus which uses primarily untempered outside air to ventilate cooking odors rather than using large volumes of expensive tempered air from within the room being ventilated. The ventilating apparatus supplies a major portion, about 80%, of the air that must be exhausted through the hood from untempered air which it draws directly from the atmosphere outside the room. This "free" outside air, never leaves the hood area. Only about 20% of the total air requirement for ventilation is tempered air which is diffused into the room adjacent the hood from the main heating or air-conditioning system thereby eliminating the need for a make-up air unit. Accordingly, my apparatus conserves considerable energy because it permits the use of primarily untempered outside air to ventilate the cooking area. The extensive use of cool outside air also reduced air pollution in that it causes grease to congeal and collect on the grease filter so that the air exhausted is cleaner. My apparatus also reduces the accumulation of grease in the ducts and on the roof of the building.

The hood enclosure is divided into three chambers by internal walls, including an insulated intake chamber, a fume collection chamber, and an exhaust chamber. Air from the outside atmosphere is forced into the intake chamber by an intake fan, and the intake chamber converges continuously toward the bottom end thereof to increase the speed of air flowing therethrough. A deflector panel is attached to the bottom of the intake chamber and deflects the air from a downward direction to a direction at an angle upward from horizontal. A throat panel attached to the intake chamber walls forms a narrow slot with the deflector panel from which the fast moving air in the intake chamber exits. The resulting curtain of air passes rearwardly and upwardly across the fume collection chamber, through a grease filter chamber and into the exhaust chamber from which it is drawn out to the atmosphere by an exhaust fan.

The fast moving stream of air functions in a manner similar to an ejector pump and causes the pressure inside the fume collection chamber to be reduced below that which it would be at if only the exhaust fan were providing the suction therein. As a result the fume laden air arising from the cooking surface is drawn into the fume collection chamber and is exhausted through the exhaust fan with more efficiency than would be the case if only the exhaust fan were being utilized. A source of tempered secondary air is injected into the room adjacent the exhaust hood ventilating apparatus. This tempered air provides an air flow toward the exhaust hood apparatus and thus entraps and carries fume laden air into the hood rather than allowing it to become dispersed into the room.

The slot from which the outside air is forced into the fume collection chamber must be relatively narrow in order to provide a narrow fast moving air stream. This air current prevents penetration thereof by the fumes and provides an air pressure differential between the moving stream and the surrounding ambient air.

Further objects, features and advantages of my invention will be apparent from the following detailed description taken in conjunction with the accompanying drawings, showing a preferred embodiment of an exhaust hood ventilating apparatus exemplifying the principles of my invention.

DESCRIPTION OF THE PREFERRED EMBODIMENT

Figure 1:
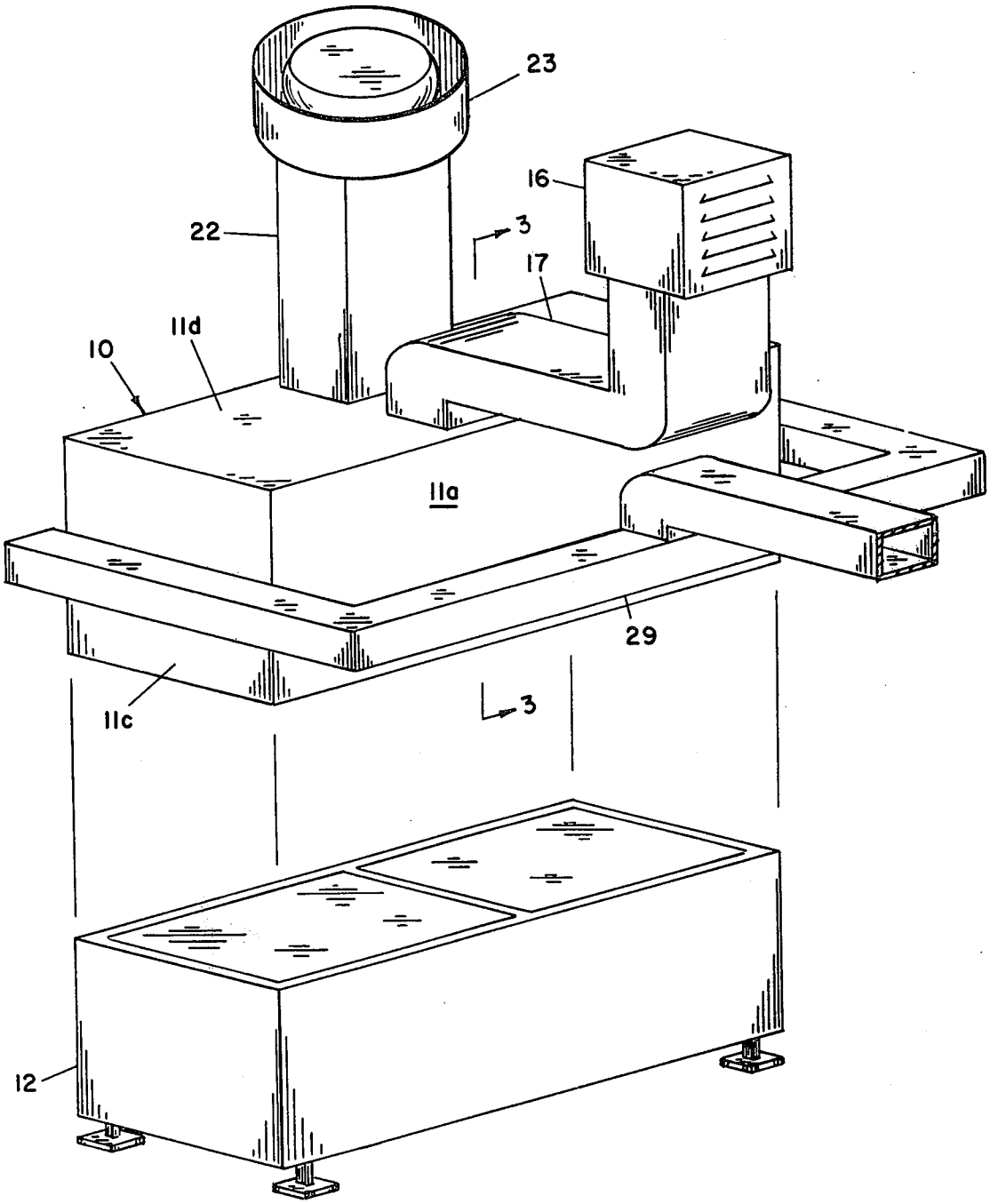
FIG. 1 is a perspective view of my exhaust hood ventilating apparatus located above a stove or other cooking surface for capturing fumes and grease arising from the cooking surface.

Referring now more particularly to the drawings, wherein like numerals refer to like parts throughout the several views, a preferred embodiment of my exhaust hood ventilating apparatus is shown generally at 10 in FIG. 1. The exhaust hood apparatus 10 has a substantially rectangular hood enclosure 11 which is adapted to be installed in the area above a stove or grill 12 in a kitchen. The hood enclosure 11 has a front longitudinal wall 11*a* and a rear longitudinal wall 11*b*. Two side walls 11*c* are attached to the ends of the front and rear longitudinal walls and a top wall 11*d* is attached to the longitudinal walls and side walls to complete the rectangular enclosure 11. The open bottom of the enclosure 11 is preferably somewhat larger than the area of the grill or stove above which the exhaust hood apparatus 10 is mounted. The hood apparatus is preferably made larger than the grill area in order to insure that a maximum amount of vapors and grease particles arising from the grill will be entrapped and pulled into the hood apparatus. Although the enclosure 11 has been shown for illustrative purposes in FIG. 1 as being substantially rectangular, it is apparent that other configurations could be utilized provided that the opening at the bottom of the enclosure was adequately sized and shaped to collect the vapors and fumes arising from the stove beneath.

Figure 2:
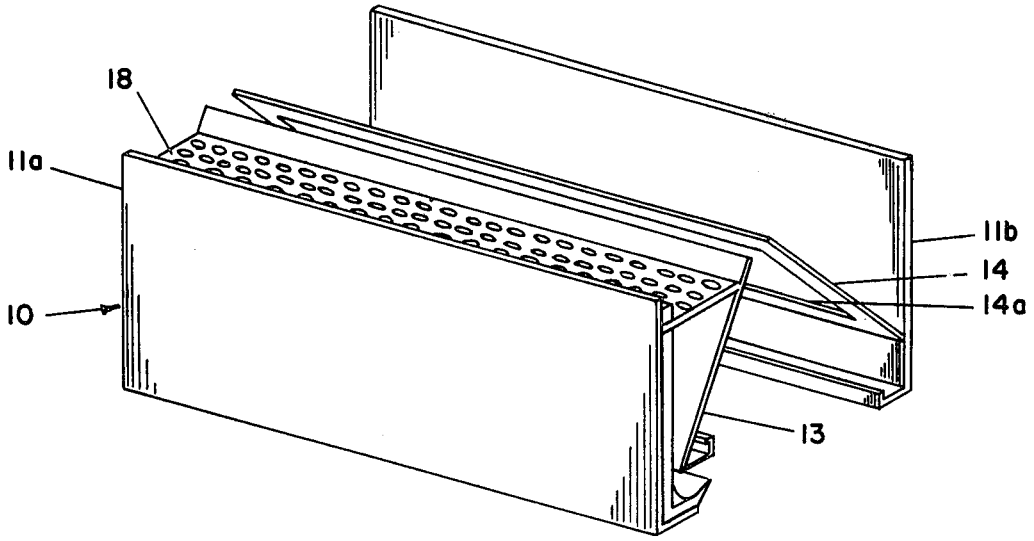
FIG. 2 is a perspective view of a portion of the exhaust hood ventilating apparatus of FIG. 1, with the top wall and the side walls of the apparatus removed to show the interior construction thereof.
Figure 3:
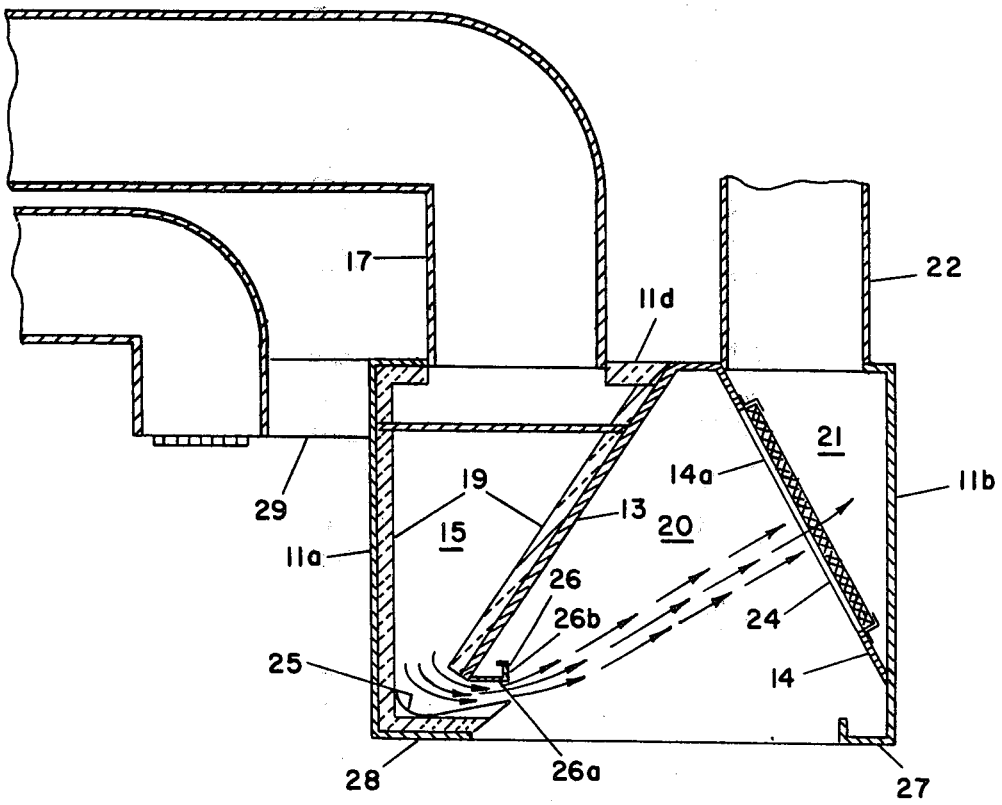
FIG. 3 is a cross-sectional view of the exhaust hood ventilating apparatus of FIG. 1, taken along the line 3—3 of FIG. 1.

The internal construction of my exhaust hood ventilating apparatus 10 is best shown in FIG. 2, wherein the side walls 11*c* and the top wall 11*d* of the enclosure 11 have been removed. The interior of the hood enclosure 11 is divided into three chambers which are defined by the walls of the enclosure 11 and by a first interior wall 13 and a second interior wall 14. The interior walls 13 and 14 and the walls of the hood enclosure 11 are preferably made of heavy gauge sheet metal such as rolled steel or stainless steel, to provide physical strength and resistance to fire. These sheet metal walls are preferably welded together, although other methods of attachment may be utilized. As shown in FIG. 2 the interior walls 13 and 14 slant toward one another toward the top of the hood enclosure in a general inverted V-shape. The chamber that is formed between the front longitudinal wall 11*a,* the first interior wall 13, the side walls 11*c* and the top wall 11*d* is the air intake chamber 15. As shown in FIG. 1, the air intake chamber 15 receives untempered air under pressure which passes from an air intake fan 16 through a duct 17 to an opening in the top wall 11*d.* As best shown in FIG. 3, the air intake chamber 15 continually converges from the top end of the chamber to the bottom end thereof. This results in an increase in the velocity of the air at the bottom of the intake chamber over the velocity of the air entering the intake chamber. To insure that the air pressure and velocity is evenly distributed throughout the length of the intake chamber 15, a distributor plate 18 is interposed within the chamber 15 and runs the length thereof. The distributor plate is comprised of a substantially flat panel which closes off the top end of the intake chamber and has a plurality of holes therein which are preferably uniformly distributed over the entire area of the plate. Such a perforated distributor plate has the function of minimizing differences in velocity between the air that is exiting from the intake chamber directly under the entrance of the duct 17 and the air that is exiting from the intake chamber at the far ends of the chamber away from the duct opening. The walls that define the intake chamber 15 are insulated with material such as a fiberglass mat 19, to thereby prevent excessive cooling of the walls of the hood enclosure and the interior walls from contact with cool or cold outside air brought in through the air intake fan 16 and the duct 17. Such cooling would result in excessive condensation of moisture and grease on the walls of the enclosure and on the interior walls.

A fume collection chamber 20 is defined by the interior walls 13 and 14 and the side walls 11*c.* The fume collection chamber 20 is positioned to entrap fumes, particles and heated air arising from the area of the stove 12. The fumes collected in the chamber 20 are passed out therefrom through an opening 14*a* in the second interior wall 14. The opening 14*a* puts the fume collection chamber 20 in communication with an exhaust chamber 21 which is defined by the interior wall 14, the rear longitudinal wall 11*b,* and the side walls 11*c.* The opening 14*a* in the second interior wall 14 extends substantially the entire longitudinal dimension of the wall 14. Fumes collected in the fume collection chamber 20 pass through the opening 14*a* into the exhaust chamber 21, and are drawn up through a duct 22 into an exhaust fan fan 23 which exhausts the fumes into the atmosphere. The exhaust fan 23 is sufficient in capacity to lower the air pressure in the exhaust chamber 21 substantially below that of the surrounding atmosphere. A grease filter 24 is mounted in the opening 14*a* separates the fume collection chamber from the exhaust chamber such that fume laden air passing from the fume collection chamber to the exhaust chamber will be passed through the grease filter 24 and have a substantial portion of the grease removed. The grease filter 24 may be any of the commonly employed types of grease filters, which, for example, may utilize a stainless steel mesh, and should extend substantially the length and width of the wall 14 to allow maximum collection of fumes in the filter. The wall 14 serves primarily to allow mounting of the grease filter 24 and to ensure that the fume laden air passes into the exhaust chamber only through the grease filter.

The moving air passing through the intake chamber 15 increases in velocity progressively as it proceeds toward the bottom end of the chamber. This air must be deflected back into the fume collection chamber 20 and out therefrom through the grease filter 24. This deflection of the air is accomplished by means of a deflector panel 25 which is mounted at the bottom end of the intake chamber and extends substantially the length of the bottom end of the intake chamber. The deflector panel comprises a panel of sheet metal or other suitable material, which is curved along its width in a general U-shape and has a sufficient curvature such that air passing downwardly through the bottom end of the intake chamber 15 is deflected by the deflector panel and is redirected into the fume collection chamber 20 in a direction at an angle upward from the horizontal. A throat panel 26 is mounted on the bottom end of the first interior wall 13 and extends substantially the length of the bottomend of the intake chamber. As shown in FIG. 3 the throat panel 26 has horizontal portion 26*a* which is attached to the first interior wall 13 and extends inwardly into the fume collection chamber 20, and a portion 26*b* which is bent upward from the horizontal portion. The throat panel is mounted in proximity to the end of the deflector panel 25 to thus define a slot between the throat panel and the deflector panel. As is shown in FIG. 3 the intake chamber 15 continuously narrows down toward the bottom end thereof and the deflector panel 25 is continuously curved to continuously deflect the air coming in contact therewith and to pass this air smoothly and continuously out through the slot between the deflector panel and the throat panel. It is also desirable that the slot between the throat panel and the deflector panel be convergent toward the opening thereof as shown in FIG. 3, thus continuously increasing the velocity of the air advancing in the intake chamber toward the slot.

The dimensions of the slot between the deflector panel 25 and the throat panel 26 are important to the proper operation of my exhaust ventilating apparatus 10. I have determined that for normal kitchen ventilation usage it is preferable that the slot width be no more than about 2 inches wide, in which case the maximum velocity of the air flowing out of the slot would be in the range of 950 ft./minute. A 1 inch slot can be utilized by increasing the air flow to a maximum velocity of about 1250 ft./minute. The slot between the throat panel 26 and deflector panel 25 should be so oriented that the stream of air emerging therefrom strikes the grease filter 24 approximately perpendicular thereto. As shown in FIG. 3, the throat panel 26 has an upturned portion **26*b* thereon, which thus allows the throat panel to serve not only as a means of defining the slot between the throat panel and the deflector panel, but also to act as a grease gutter or trough for grease that may congeal and accumulate on the first interior wall 13. The throat panel 26 may decline slightly from one end of the hood enclosure to the other so that grease accumulating on the throat panel may flow to a grease collector (not shown) where it can be removed. A grease cutter 27 is also provided at the bottom of the rear wall 11*b* for accumulating and transporting grease that may have formed on the second interior wall 14. A bottom panel 28 is attached to the front panel 11*a* underneath the deflector panel 25 in the horizontal position shown in FIG. 3. It is preferable that the bottom panel 28 be kept fairly narrow so that the major portion of the fumes arising from the stove will flow naturally up into the fume collection chamber 20. The bottom panel 28 is preferably constructed of a heavy gauge sheet metal such as rolled steel or stainless steel, in a manner similar to the construction of the walls of the enclosure and the interior walls 13 and 14.**

The portion of my exhaust hood ventilating apparatus which consists of the fume collection chamber 20, the exhaust chamber 21, the grease filter 24 and the exhaust fan 23, function analogously to the usual exhaust hood which simply acts as a suction device to draw fume laden air through the hood out into the atmosphere. With no air flowing through the air intake chamber 15, the suction produced by the exhaust fan 23 will produce an air pressure in the fume collection chamber 20 which is somewhat below ambient atmospheric pressure, thus resulting in a net flow of air into the fume collection chamber. As is well known in the air conditioning industry, the suction effects from a hood do not extend a great distance beyond the bottom area of the hood. It is thus desirable that the hood be placed fairly close to the surface from which fumes are arising and that the exhaust fan be of sufficient capacity to pull a great quantity of air out of the exhaust hood. If all of the air exhausted from the hood were provided from the heated air in the room this would result in a substantial heat loss from the room during the winter and a similar loss of air conditioned air during the summer. The moving stream of air issuing from the slot between the throat panel 26 and the deflector panel 25 in my ventilating apparatus 10 will tend to mix somewhat with the air which it is in contact with and will carry this air and any particles of grease or fumes which are intermixed therewith into the grease filter 24 and therethrough to the exhaust chamber 21. My ventilating hood apparatus will thus draw more fume laden air into the exhaust chamber 21 than would a similar exhaust hood apparatus without the stream of forced air which utilized only the suction produced by the exhaust fan 23. Since the air that is discharged through the slot is provided from outside air and does not require heating or cooling in any way, there is a very substantial decrease in the heat load on the heating and air conditioning system.

I have determined that my exhaust hood ventilating apparatus functions most effectiently when approximately 80% of the air drawn out through the exhaust fan 23 is provided by air forced through the slot between the throat panel 26 and the deflector plate 25, and 20% of such air is provided by heated or cooled air which is forced into the room in which the exhaust hood ventilating apparatus 10 is situated. This heated or cooled air is provided by the ducts 29 as shown in FIG. 1, wherein outlets for the tempered air are provided at various positions around the ventilating apparatus 10. It is necessary that there be a secondary source of tempered air being forced into the room at a distance from the exhaust hood apparatus in order to provide the necessary flow toward the exhaust hood to entrain the particles of air and pull them into the hood rather than allowing them to disperse throughout the room. It is preferable that this air be forced into the room rather than simply being drawn in by suction from the ventilating apparatus.

As mentioned above, it is most desirable that the slot between the throat panel and the deflector panel be less than approximately 2 inches wide for the volumes of air normally exhausted in hoods utilized in kitchens and other similar applications. The narrow stream of air issuing from the slot will not tend to disperse substantially before reaching the grease filter 24, and for a sufficiently narrow slot wherein the deflector panel and the throat panel converge smoothly and continuously toward the slot, the air stream issuing therefrom can develop substantially laminar flow for some distance from the slot. The capability of obtaining laminar flow is enhanced because the air issuing from the slot is issuing into a moving stream of air produced by the air being drawn up into the exhaust chamber 21 and through the fan 23. Thus the relative velocity of the air issuing from the slot and the surrounding ambient air is less than the absolute velocity at which the air exits from the slot. Even if the flow issuing from the slot is turbulent, the flow will be relatively narrow and fast moving with minimal development of vortexes and eddys. Such smooth flow is desirable since it avoids extensive mixing of the air curtain with the fume laden air arising from below, and also avoids penetration of the air curtain by the fume laden air so that very little of the fumes reach the interior walls 13 and 14. It is desirable to minimize the vortexing of the fume laden air, since such vortexing results in deposits of grease on the interior walls and also substantially reduces the pressure drop developed in the fume collection chamber 20.

It is preferable that the second interior wall 14 be at an angle greater than 45° with the horizontal so that grease that does accumulate either on the filter 24 or on the interior wall 14 flows downwardly into the grease gutter 27 or is trapped in the filter, and does not form into large droplets which fall from the interior wall into the food preparation surface below.

Figure 4:
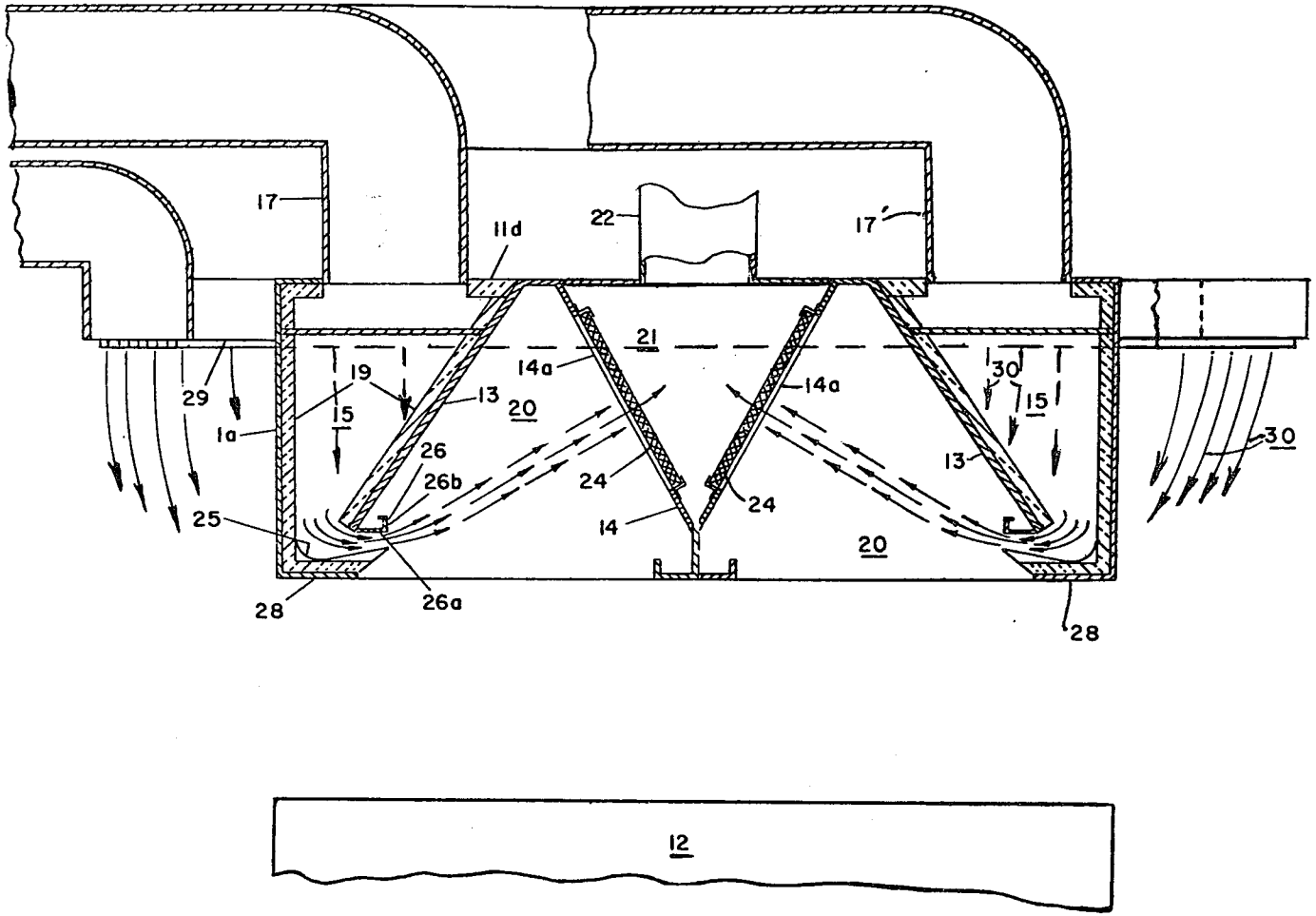
FIG. 4 is an illustration of an exhaust hood embodiment.

In FIG. 4, the present invention is shown applied to an island unit which is spaced from the several walls of a room and permits the user to move completely about the grill 12. In FIG. 4, corresponding elements of the embodiments of FIGS. 1 - 3 will be identified by corresponding numbers for simplicity and clarity.

In the embodiment of FIG. 4, the hood apparatus 10 includes a substantially rectangular hood enclosure 11 adapted to be secured from the ceiling above the island type grill 12. Within the enclosure, a first fume collection chamber 20 is formed to one side of the unit and a second similar fume collection chamber 20' is formed to the opposite side. The collection chamber 20 is formed by walls 13 and 14. Fume collection chamber 20' is similarly formed by reversely positioned walls 13' and 14' such that the filters 24 and 24' are located adjacent to the central portion of the rectangular enclosure 11. They form the opposite side walls of a centrally located exhaust chamber 21. A common duct 22 is operative to exhaust the fumes into the atmosphere. Supply chambers 15 and 15' are similarly formed to the opposite ends of the rectangular enclosure and are connected to individual air entrance ducts 17 and 17'. These ducts may be supplied from a common fan or from individual fans. The fume collection chambers 20 and 20' are thus constructed as essentially mirror images about a central vertical plane. In accordance with the embodiment of the invention, a continuous secondary tempered air duct 29 is mounted in complete encirclement about the hood enclosure 11. The duct 29 is located in upwardly spaced relation to the lower end of the enclosure 11 and is provided with an essentially continuous bottom air diffuser opening which develops a soft velocity air curtain about the total hood enclosure. The air flow is shown by both solid and dotted lines 30, with the dotted lines indicating the air flow to the backside of the encircling duct 29. The secondary tempered air diffuser is located in upward relation and particularly, generally at the ceiling line. The spaced location results in significant reduction in the velocity so as to avoid objectionable drafts over the cooks and other personnel. In a preferred construction as applied to a kitchen area, the secondary tempered air again is selected to provide about 20% of the total air exhausted by the hood apparatus, the other 80% being supplied via the ducts 17 and 17'. The invention with the ability of minimizing drafts and dispersion of the fumes has been found to be particularly significant in island units where they may be located centrally of the room and particularly subjected to the effects of door openings and the like.

It is understood that my invention is not confined to the particular construction and arrangements of parts herein illustrated and described, but embraces all such modified forms thereof as come within the scope of the following claims.

Various modes of carrying out the invention are contemplated as being within the scope of the following claims, particularly pointing out and distinctly claiming the subject matter which is regarded as the invention.

I claim:

1. Ventilating apparatus for ventilating a room which has tempered air introduced therein, exhaust apparatus comprising:

a. an exhaust hood having front, side and rear walls, b. an interior wall which with the front wall and side walls of said exhaust hood defines an intake chamber within said exhaust hood, said interior wall and front wall converging downwardly, c. a grease filter which with the rear wall and side walls of said exhaust hood defines an exhaust chamber within said hood, d. said interior wall of the intake chamber and said grease filter of the exhaust chamber defining a fume collection chamber therebetween, e. air intake means for drawing ambient air from outside the room being ventilated and forcing such air under pressure into said intake chamber, f. a throat panel extending substantially along the length of the bottom of said interior wall, g. a deflector panel also extending substantially along the length of the bottom of said front wall and positioned in spaced relation below said throat panel to form a longitudinally extending slot with said throat panel, the width of said slot being no more than about two inches, said deflector panel being continuously curved along its width to deflect air introduced into said intake chamber through said slot rearwardly and upwardly through said grease filter and into said exhaust chamber, and h. exhaust means for drawing air and fumes out of said exhaust chamber and exhausting such air and fumes into the atmosphere outside the room being ventilated, said exhaust means having capacity to exhaust a minimum of 20% more air by volume than introduced into said intake chamber by said air intake means.

2. The ventilating apparatus as specified in claim 1 including heat insulation material insulating the walls of said intake chamber.

3. The ventilating apparatus as specified in claim 1 including a perforated distributor plate mounted across said intake chamber whereby air forced into said intake chamber by said air intake means is substantially uniformly distributed in velocity along the length of said intake chamber as the air passes through said distributor plate.

4. Ventilating apparatus for ventilating a room which has tempered air introduced therein, comprising: an exhaust hood having an outer enclosing wall with a bottom opening and having an interior wall means defining an intake chamber within said exhaust hood terminating in the lower portion of the outer enclosure wall in a discharge nozzle means and an exhaust passageway means within said hood including a bottom fume collection chamber between the discharge nozzle means and the exhaust passageway means, air intake means for drawing air from outside the room being ventilated and forcing such air under pressure into said intake chamber, said intake chamber being constructed to form a continuous smooth walled passageway for said air to said nozzle means to create a smooth uninterrupted flow, said nozzle means forming a continuation of said chamber and being continuously smoothly curved along its width to maintain a smooth uninterrupted deflection through said nozzle means of the air introduced into said nozzle means from said intake chamber, said air stream passing upwardly through the fume collection chamber into the exhaust passageway means for drawing of fumes into the collection chamber and for upward movement of the air and fumes out of said exhaust passageway and from the room being ventilated.

5. The ventilating apparatus of claim 4 including power air suction means located within said exhaust passageway means and having capacity to exhaust a minimum of 20% more air by volume than introduced into said intake chamber by said air intake means.

6. The ventilating appartus of claim 4 wherein said intake chamber includes a front and rear wall defining a progressively reduced cross-section to said nozzle means.

7. The ventilating apparatus of claim 4 including first and second intake chamber and nozzle means assemblies on opposite sides of the enclosing wall to form an island hood.

8. The ventilating apparatus of claim 7 having a centrally located common exhaust for receiving of the air streams from said first and second assemblies.

9. Ventilating apparatus for ventilating a room which has tempered air introduced therein, exhaust apparatus comprising: an exhaust hood having an outer enclosing wall with a bottom opening and having an interior wall means defining an intake chamber extending along at least one enclosing wall within said exhaust hood and terminating in the lower portion of the outer enclosure wall in a corresponding extended discharge nozzle means and having an exhaust chamber within said hood and a bottom fume collection chamber between the discharge nozzle means and the exhaust chamber, air intake means for drawing air from outside the room being ventilated and forcing such air under pressure into said intake chamber, said intake chamber having front and back walls extending downwardly from the intake chamber toward each other to form a continuous smooth walled passageway of a reduced cross-section for said air to said nozzle means to create a smooth uninterrupted accelerated flow, said nozzle means having a top wall and a curved bottom wall forming a continuation of said intake chamber of a continuously reduced cross-section to a discharge slot to maintain smooth uninterrupted deflection and acceleration of the air and a relatively thin air stream passing through the collection chamber into said exhaust chamber.

10. The ventilating apparatus of claim 9 having a powered exhaust means in said exhaust chamber having a capacity to exhaust a minimum of 20% more air by volume than introduced into said intake chamber by said air intake means, and a distributor plate means located within the intake means for uniformly distributing the air into the intake chamber.

11. A ventilating hood apparatus for exhausting of air from a surrounding area, comprising an outer wall assembly having means for suspending of the assembly from a ceiling structure and having a bottom opening to an exhaust and fume collection chamber having an exhaust outlet to define an island type hood, an interior wall assembly defining an intake chamber including portions at least to the opposite sides thereof, each of said intake chambers being constructed with an upper air inlet portion and bottom outlet portion adjacent said bottom opening, said intake chambers having a smoothly restricted cross-section from the inlet portion to the outlet portion for forming of a smoothly accelerating air flow to the outlet portion, nozzle means connected to and forming a construction of the outlet portions, said nozzle means extending laterally from the outlet portion into the exhaust and collection chamber, said nozzle means including an essentially shallow U-shaped bottom wall including a back wall portion extending downwardly and forwardly toward the chamber to a front wall portion extending upwardly and forwardly to the chamber for smoothly and continuously changing the direction of the flow of the air from the outlet portion laterally and angularly across and upwardly into said exhaust and fume collection to form a pair of thin air curtains defining an inverted U-shaped air configuration across the bottom opening to said exhaust outlet.

12. The apparatus of claim 11 wherein said nozzle means includes a progressively reduced cross-section from the outlet portion to a discharge slot.

13. Ventilating apparatus for ventilating a room which has tempered air introduced therein, comprising: an exhaust hood having an outer enclosure defining a bottom opening, a collection and exhaust chamber above said opening and including an exhaust filter in one wall of said chamber, and said chamber having a smooth walled air intake passageway extending vertically from the upper portion of the enclosure downwardly to the bottom portion of the enclosure, means for forcing air under pressure into said intake passageway, a nozzle means connected to the lower end of the passageway and forming an extension of said passageway, said nozzle means including an essentially shallow U-shaped bottom wall having a back wall portion extending downwardly and forwardly toward the chamber to a front wall portion extending upwardly and forwardly to the chamber to maintain a smooth uninterrupted deflection of the air from said intake passageway into said collection and exhaust chamber and defining a laminar flowing jet having a flow path essentially extending across said chamber and upwardly to engage the filter substantially perpendicular and defining a pressure condition for drawing air upwardly through said opening, and said front portion of the nozzle means directing said flowing jet to engage the filter in substantial upwardly spaced relation to said bottom opening.

14. The apparatus of claim 13 wherein said intake chamber is formed with a continuously reduced cross-section to establish a smooth accelerated flow of the air into said nozzle means and particularly into the back wall portion for said smooth uninterrupted deflection.

* * * * *

UNITED STATES PATENT AND TRADEMARK OFFICE

CERTIFICATE OF CORRECTION

PATENT NO. : 4,047,519

DATED : Sept. 13, 1977

INVENTOR(S) : Louis A. Nett

It is certified that error appears in the above—identified patent and that said Letters Patent is hereby corrected as shown below:

The term of this patent subsequent to Sept. 7, 1993 has been disclaimed.

Signed and Sealed this

*Ninth* Day of *September 1980*

[SEAL]

*Attest:*

SIDNEY A. DIAMOND

*Attesting Officer*

*Commissioner of Patents and Trademarks*